US006247191B1

(12) United States Patent
Detar et al.

(10) Patent No.: US 6,247,191 B1
(45) Date of Patent: Jun. 19, 2001

(54) LOCOMOTIVE SANITATION APPARATUS AND METHOD OF PROTECTING THE SAME FROM FREEZING

(75) Inventors: Gail L. Detar; Anne K. Eisert; Todd M. Kindel; Lamar K. Ledbetter, all of Erie, PA (US)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 09/479,449

(22) Filed: Jan. 12, 2000

Related U.S. Application Data

(60) Provisional application No. 60/172,960, filed on Dec. 21, 1999.

(51) Int. Cl.[7] ..... E03D 9/04; E03D 9/12

(52) U.S. Cl. ..... 4/322; 4/210; 4/347; 454/84; 454/103; 454/117

(58) Field of Search ..... 4/322, 347, 210, 4/209 R, 661, 475; 454/84, 103, 117

(56) References Cited

U.S. PATENT DOCUMENTS 525,104 * 8/1894 Herrick ..... 4/322
949,212 * 2/1910 Bogart ..... 4/210
1,021,663 * 3/1912 Cronk ..... 4/210 X
3,780,677 * 12/1973 Frankel ..... 4/111.4
4,214,324 * 7/1980 Kemper et al. ..... 4/321 X
6,038,710 * 3/2000 Baron ..... 4/322 X

* cited by examiner

*Primary Examiner*—Gregory L. Huson
*Assistant Examiner*—Kathleen J. Prunner
(74) *Attorney, Agent, or Firm*—Carl A. Rowold, Esq.; Holland & Knight LLP; David G. Maire, Esq.

(57) ABSTRACT

A sanitary system for a locomotive wherein the treatment tank is protected from freezing by the use of the heat available in the exhaust air removed from the toilet compartment. A sealed and insulated compartment is formed around the treatment tank, and a vent is connected between the toilet room and the insulated compartment. A suction line located at an opposed position in the insulated compartment is used to direct the flow of air from the toilet room, through the insulated compartment around the treatment tank, to the locomotive exterior. By eliminating the need for heat tracing of the treatment tank, this invention reduces the cost and energy usage of the locomotive sanitary system.

21 Claims, 1 Drawing Sheet

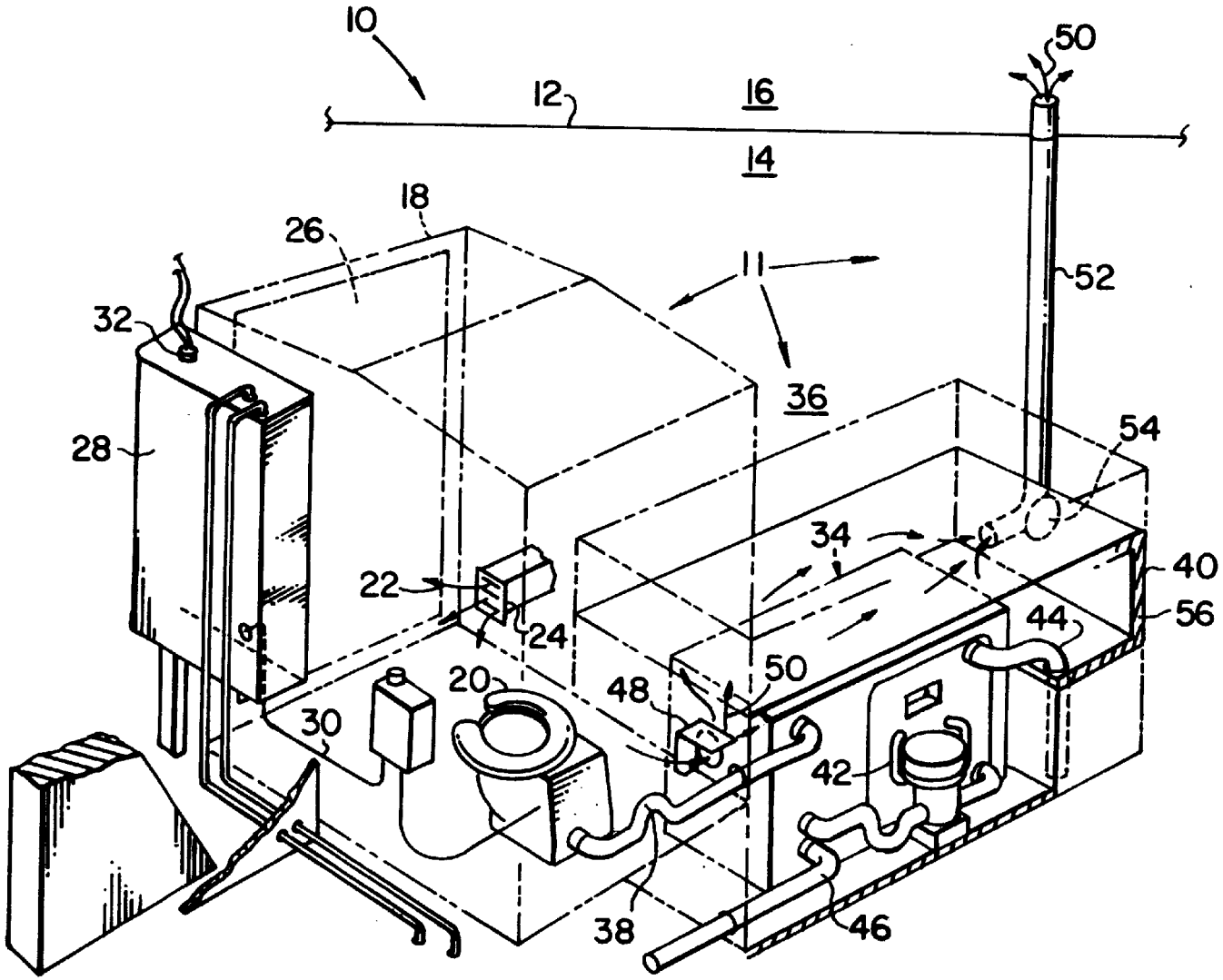
10
12
14
16
18
20
22
24
26
28
30
32
34
36
38
40
42
44
46
48
50
52
54
56

LOCOMOTIVE SANITATION APPARATUS AND METHOD OF PROTECTING THE SAME FROM FREEZING

This application claims the benefit of the Dec. 21, 1999, filing date of provisional patent application serial number 60/172,960.

BACKGROUND OF THE INVENTION

The present invention relates generally to the field of locomotives, and more specifically to the field of winterizing water containing components of the locomotive, and specifically to winterizing the sanitation equipment on-board a locomotive.

It is known to provide toilet facilities on-board a locomotive for use by the crew during the operation of the locomotive. A separate toilet room is typically provided adjacent the cabin to provide privacy for the user. The toilet room is generally provided with conditioned air, and in particular, with heated air during periods of operation of the locomotive in frigid environments. Because the toilet room is heated, there is little concern that the water contained within the toilet and associated piping within the toilet room will freeze and thereby cause structural damage due to the expansion of the water as it freezes. However, the toilet drain is typically piped to a treatment tank located outside the toilet room, and the treatment tank is usually located in an unconditioned air space. Therefore, some form of protection must be provided to prevent the water in the treatment tank from freezing.

It is known to surround the treatment tank and associated piping located in an unconditioned air space with heat trace. Heat trace is a term used to describe any of several forms of heat generating material that is wrapped around or layered over a component. Heat trace typically includes an insulated electrical resistance heater wire or mesh attached to a layer of thermal insulation or blanketing. The heat trace is supplied with an electrical current, thereby generating heat which is trapped against the component by the insulation. While effective to protect a component against freezing, heat trace is expensive to install, to maintain and to operate.

BRIEF DESCRIPTION OF THE INVENTION

Thus there is a particular need for an improved method for preventing the freezing of water in the sanitation system of a locomotive. There is also a need for a sanitation system for a locomotive that is less costly to install, to maintain and to operate.

A sanitation apparatus for a locomotive is described herein as having a first compartment; a toilet disposed within the first compartment; a second compartment; a treatment tank disposed within the second compartment; a drain line connected between the toilet and the treatment tank; an air supply connected to the first compartment for supplying air to the first compartment; a vent connected between the first compartment and the second compartment, the vent operable to deliver at least a portion of the air from the first compartment to the second compartment; and a suction line connected to the second compartment for moving the at least a portion of the air out of the second compartment.

A method for reducing the energy consumption of a locomotive is also described, the locomotive having a toilet room containing conditioned air from which air must be exhausted to the exterior of the locomotive, and further having a treatment tank that must be protected from freezing, the method comprising the steps of exhausting a flow of air from the toilet room to the exterior of the locomotive; and using heat energy from the flow of air to prevent the freezing of the treatment tank.

BRIEF DESCRIPTION OF THE DRAWING

The FIGURE provides a perspective view of a sanitation apparatus installed in a locomotive wherein the treatment tank is protected from freezing without the use of heat trace.

DETAILED DESCRIPTION OF THE INVENTION

The FIGURE illustrates a perspective view of a portion of a locomotive 10 having a body 12 defining the locomotive interior 14 and exterior 16. The locomotive 10 includes a sanitation apparatus 11 for the convenience of the operators of the locomotive 10. A toilet room 18 is formed as a compartment within the interior 14 to house the toilet 20 and associated piping and fixtures. The toilet room 18 is a conditioned air space, being supplied with conditioned air 22 through an air supply such as outlet 24 of the HVAC system. Alternatively, the air supply for the toilet room may be by simple leakage around door 26 or by other openings between the toilet room and other conditioned spaces within the interior 14. The tank 28 for storing water for the toilet 20 may be mounted to an outside surface of one of the walls of the toilet room 18, with the water supply line 30 between tank 28 and toilet 20 being routed within the toilet room 18. The tank 28 may be located within a conditioned air space or otherwise protected from freezing such as by electrical heater 32.

A treatment tank 34 is installed within the interior 14 outside the toilet room 18 in an unconditioned air space 36. Treatment tank 34 is connected to the toilet 20 by drain line 38. A treatment tank compartment 40 is formed by sealing and insulating an air space around the treatment tank 34. Compartment 40 may enclose not only the treatment tank 34 but also proximate associated equipment such as a chlorinating system 42, vent line 44 and drain line 46.

It is known to exhaust air from a toilet room in order to control the concentration of odors in the room. Prior art locomotives include an exhaust vent and a fan or other means for exhausting a flow of air from the toilet room to the exterior of the locomotive. The inventors of the present application have discovered that heat energy from such a flow of exhaust air may be used advantageously to prevent the freezing of the water in a treatment tank or other component of the locomotive. They have accomplished this by forming the insulated compartment 40 around the treatment tank 34, and directing a flow of air from the toilet room 18 through the compartment 40 to the exterior 16.

A vent 48 is connected in fluid communication between the toilet room 18 and compartment 40 and is operable to deliver at least a portion 50 of the air 22 from the toilet room 18 to the treatment tank compartment 40. Vent 48 may be hooded to prevent reverse air flow and may be screened to prevent the passage of large solid objects there through.

A suction line 52 is connected in fluid communication between the compartment 40 and the exterior 16 for exhausting the air 50 out of compartment 40 to the exterior 16. Line 52 may include a fan 54 or other means for moving air as may be known in the art. Advantageously, vent 48 and suction line 52 are disposed at opposed positions in the compartment 40 in order to move the air 50 proximate the treatment tank 34 in order to ensure thorough and even heating of the tank 34. Because the air 22,50 is heated during periods of freezing exterior temperatures, the process of moving air 50 from the toilet room, through the compartment 40, to the locomotive exterior 16 will maintain the treatment tank 34 above a freezing temperature, while at the same time providing the necessary venting of odors from the toilet room 18.

Prior art locomotives that rely upon heat trace for freeze protection of the sanitation system components may be modified to reduce the energy consumed during operation. The heat trace may be removed from all or portions of the treatment tank 34 and/or other components of the sanitation system or other temperature sensitive systems of the locomotive. An air space may then be sealed and insulated around the treatment tank or component. In one embodiment this may be done by constructing a compartment 40 including insulation 56 disposed proximate the walls of the compartment 40. The existing toilet room vent, or a newly formed vent 48, may then be connected to ventilate the air space with exhaust air 50 from the toilet room 18. Air 50 may then be moved from the toilet room 18 through the air space to the exterior 16 of the locomotive 10.

The amount and location of insulation 56 and the rate of flow of air 50 will vary depending upon the design requirements of the particular locomotive. In one embodiment for a model Dash 9-44CW locomotive manufactured by the assignee of the present invention, insulation 56 having an R value of at least R3 under the treatment tank 34 and an R value of at least R4 elsewhere around compartment 40, along with a flow rate for air 50 of at least 20 cubic feet per minute, were found sufficient to prevent the water in the treatment tank from freezing with an ambient temperature of minus 40 degrees Fahrenheit. The elimination of heat trace for this design resulted in a savings of over 500 watts of heat energy when compared to the prior art design, as well as the elimination of the cost of the heat trace installation and maintenance.

While the preferred embodiments of the present invention have been shown and described herein, it will be obvious that such embodiments are provided by way of example only. Numerous variations, changes and substitutions will occur to those of skill in the art without departing from the invention herein. Accordingly, it is intended that the invention be limited only by the spirit and scope of the appended claims.

What is claimed is:

1. A sanitation apparatus for a locomotive comprising:

a first compartment;

a toilet disposed within the first compartment;

a second compartment;

a treatment tank disposed within the second compartment;

a drain line connected between the toilet and the treatment tank;

an air supply operative to supply air to the first compartment;

a vent connected between the first compartment and the second compartment, the vent operable to deliver at least a portion of the air from the first compartment to the second compartment; and a suction line connected to the second compartment for moving the at least a portion of the air out of the second compartment.

2. The sanitation apparatus of claim 1, further comprising thermal insulation disposed proximate the second compartment.

3. The sanitation apparatus of claim 2, wherein the insulation has an R value of at least R3 under the treatment tank and an R value of at least R4 elsewhere around the second compartment, and further comprising a means for moving air at a rate of at least 20 cubic feet per minute connected to the suction line.

4. The sanitation apparatus of claim 1, wherein the air supply comprises a heated air supply.

5. The sanitation apparatus of claim 1, wherein the vent and suction line are disposed at opposed positions in the second compartment in order to move the at least a portion of the air proximate the treatment tank.

6. The sanitation apparatus of claim 1, wherein the suction line is vented to the exterior of the locomotive.

7. A method for modifying the sanitation system of a locomotive, the sanitation system comprising a toilet room for housing a toilet, the toilet room being supplied with conditioned air, a vent connected to the toilet room for moving air from the toilet room to the locomotive exterior, a treatment tank connected to the toilet and disposed in an unconditioned space, and heat trace disposed around the treatment tank, the method comprising the steps of:

removing the heat trace from the treatment tank;

sealing and insulating an air space around the treatment tank;

connecting the vent to the air space; and moving air from the toilet room through the air space to the exterior of the locomotive.

8. The method of claim 7, wherein the step of connecting the vent to the air space further comprises:

connecting a vent between the toilet room and the air space; and connecting a suction line to the air space.

9. The method of claim 8, further comprising the step of connecting the vent and suction line at opposed positions in the air space so that the step of moving air comprises moving air proximate the treatment tank.

10. A method of protecting the sanitation system of a locomotive from freezing, the sanitation system comprising a toilet room supplied with conditioned air, a toilet disposed in the toilet room, and a treatment tank connected to the toilet and disposed in an unconditioned space, the method comprising the steps of:

forming a compartment around the treatment tank;

connecting a vent between the toilet room and the compartment; and maintaining the treatment tank above a freezing temperature by moving air from the toilet room, through the compartment, to the locomotive exterior.

11. The method of claim 10, further comprising the steps of:

connecting a suction line to the compartment; and using the suction line to draw air out of the compartment to accomplish the step of moving air from the toilet room.

12. The method of claim 11, further comprising the step of disposing the vent and the suction line at opposed positions in the compartment so that the air is moved through the compartment proximate the treatment tank.

13. The method of claim 11, further comprising the step of insulating the compartment.

14. A locomotive comprising:

a body defining the locomotive interior and exterior;

a toilet room formed within the interior;

a toilet disposed in the toilet room;

a treatment tank connected to the toilet and located within the interior and outside the toilet room;

a compartment formed to surround the treatment tank;

a vent between the compartment and the toilet room;

a means for moving air from the toilet room, through the vent, through the compartment, to the exterior.

15. The locomotive of claim 14, wherein the means for moving air further comprises a suction line connected to the compartment.

16. The locomotive of claim 15, wherein the vent and suction line are disposed at opposed positions in the compartment in order to move the air proximate the treatment tank.

17. The locomotive of claim 14, wherein the compartment is thermally insulated.

18. The locomotive of claim 17, further comprising the insulation having an R value of at least R3 under the treatment tank and an R value of at least R4 elsewhere around the compartment, and wherein the means for moving air further comprises a means for moving air at a rate of at least 20 cubic feet per minute.

19. A method for reducing the energy consumption of a locomotive, the locomotive having a toilet room containing conditioned air from which air must be exhausted to the exterior of the locomotive, and further having a treatment tank that must be protected from freezing, the method comprising the steps of:

exhausting a flow of air from the toilet room to the exterior of the locomotive; and using heat energy from the flow of air to prevent the freezing of water in the treatment tank.

20. The method of claim 19, further comprising the steps of:

forming an insulated compartment around the treatment tank; and directing the flow of air from the toilet room through the insulated compartment to the exterior of the locomotive.

21. The method of claim 20, further comprising the steps of:

installing a vent between the toilet room and the insulated compartment;

installing a suction line between the insulated compartment and the exterior of the locomotive; and locating the vent and the suction line at opposed positions in the insulated compartment in order to direct the flow of air proximate the treatment tank.

* * * * *